US007131299B1

(12) United States Patent
Huang

(10) Patent No.: US 7,131,299 B1
(45) Date of Patent: Nov. 7, 2006

(54) COMBINATION LOCK AND PADLOCK COMBINATION WITH OPENING WARNING DEVICE

(75) Inventor: Chien-Chien Huang, Changhua County (TW)

(73) Assignee: Glox Industry Co., Ltd., Chang Hua County (TW)

( * ) Notice: Subject to any disclaimer, the term of this patent is extended or adjusted under 35 U.S.C. 154(b) by 0 days.

(21) Appl. No.: 11/435,443

(22) Filed: May 16, 2006

(51) Int. Cl.
*E05B 37/06* (2006.01)

(52) U.S. Cl. ..... 70/21; 70/28; 70/312; 70/284; 70/285; 70/432

(58) Field of Classification Search ..... 70/21–29, 70/312, 432, 284, 285, 45–47
See application file for complete search history.

(56) References Cited

U.S. PATENT DOCUMENTS

| | | | | |
|---|---|---|---|---|
| 4,803,856 | A * | 2/1989 | Ling | 70/28 |
| 6,792,778 | B1 * | 9/2004 | Chen | 70/21 |
| 6,877,345 | B1 * | 4/2005 | Misner et al. | 70/25 |
| 6,928,842 | B1 * | 8/2005 | Huang | 70/21 |
| 6,997,023 | B1 * | 2/2006 | Huang | 70/21 |
| 7,007,520 | B1 * | 3/2006 | Lin | 70/21 |
| 7,007,521 | B1 * | 3/2006 | Misner et al. | 70/21 |
| 2002/0088256 | A1 * | 7/2002 | Taylor et al. | 70/25 |
| 2005/0235706 | A1 * | 10/2005 | Ling et al. | 70/29 |
| 2005/0262902 | A1 * | 12/2005 | Ling et al. | 70/21 |
| 2005/0262903 | A1 * | 12/2005 | Ling et al. | 70/21 |
| 2006/0032274 | A1 * | 2/2006 | Yu | 70/25 |
| 2006/0075793 | A1 * | 4/2006 | Yu | 70/30 |
| 2006/0107708 | A1 * | 5/2006 | Yu | 70/21 |
| 2006/0107709 | A1 * | 5/2006 | Yu | 70/21 |
| 2006/0107710 | A1 * | 5/2006 | Yu | 70/25 |
| 2006/0123857 | A1 * | 6/2006 | Ling et al. | 70/21 |
| 2006/0130540 | A1 * | 6/2006 | Lin | 70/21 |
| 2006/0156769 | A1 * | 7/2006 | Yu | 70/21 |

* cited by examiner

*Primary Examiner*—Suzanne Dino Barrett
(74) *Attorney, Agent, or Firm*—Pro-Techtor Int'l Services

(57) ABSTRACT

A combination lock and padlock combination as a lock is disclosed that includes a spring-biased pivot assembly comprising a locking dog and an engagement member; a push button pivotably disposed on the pivot assembly; a U-shaped shackle comprising a slotted leg for locking the locking dog; a spring-biased L-shaped catch assembly comprising a sliding member at one end and a tab projected from the other end; and a spring-biased opening warning assembly pivotably provided in the housing and comprising a locked mark at one end exposed at a window in a locked position of the lock and an open mark adapted to switch with the locked mark. Once the lock is opened by a key by one of a number of persons sharing the lock, the open mark is exposed on the window and other person(s) may be aware of same by seeing the open mark.

1 Claim, 9 Drawing Sheets

COMBINATION LOCK AND PADLOCK COMBINATION WITH OPENING WARNING DEVICE

BACKGROUND OF THE INVENTION

1. Field of Invention

The present invention relates to combination lock and padlock combinations and more particularly to such a combination lock and padlock combination (i.e., lock) having means for warning that the lock has been opened by a key by another person who shares the ownership of the lock.

2. Related Art

Combination lock and padlock combinations are well known. For example, U.S. Pat. Nos. 6,928,842 and 6,792,778 both disclose a combination lock and padlock combination which have the same inventor as the present application.

However, means for warn that the lock has been opened by a key by another person who shares the ownership of the lock is not disclosed in either prior patent. Hence, a need has arisen for an improved combination lock and padlock combination having means for warning that the lock has been opened by a key by another person who shares the ownership of the lock in order to overcome the inadequacy of the prior art and contribute significantly to the advancement of the art.

SUMMARY OF THE INVENTION

It is therefore an object of the present invention to provide a combination lock and padlock combination as a lock such that once the lock is opened by a key by one of a number of persons sharing the lock, an open mark is exposed on a window of the lock housing and any of other persons may be aware of the same by visually observing the open mark.

To achieve the above and other objects, the present invention provides a combination lock and padlock combination as a lock comprising a housing comprising a cover including a window proximate its top, and a base including a plurality of spaced seats, a groove adjacent the seats, a side cavity in communication with the external and both the groove and the seats, and a top hole in communication with the external and the cavity; a tumbler wheel assembly seated on the seats and comprising a plurality of tumbler wheels, a plurality of hollow cylinders each fitted in the tumbler wheel, a spring-biased locking bar disposed axially in the cylinders and having an enlarged head; a key turning mechanism disposed in the groove and comprising a keyhole and a rotatable shaft including a projection of half circular section protruded from an inner end thereof toward the cavity; a spring-biased pivot assembly disposed in the cavity and being pivotal about the base, the pivot assembly comprising a latch extended from one end and including a locking dog at its open end, and an engagement member contacted the projection; an arm-shaped push button disposed on the pivot assembly, both the push button and the pivot assembly being co-pivotal about the base, the push button comprising an inner nose urged against the head of the locking bar; a U-shaped shackle comprising one spring-biased leg pivotably provided in the housing, and a slot at an end of the other leg with the locking dog fastened therein in a locked position of the lock; a spring-biased L-shaped catch assembly comprising a sliding member at one end and a tab projected from the other end; and a spring-biased opening warning assembly pivotably provided in the housing and comprising a locked mark at one end exposed at the window in the locked position of the lock, an open mark adjacent the locked mark, and a hook at the other end; whereby inserting a key into the keyhole to clockwise turn the projection about 90 degrees will cause the projection to push the sliding member and move the tab toward a top of the housing, thereby clockwise pivoting the locked mark until the hook is stopped by the engagement member and the open mark is exposed at the window; continuing to turn the projection will clockwise pivot the engagement member to cause the locking dog to clear the slot, thereby counterclockwise pivoting the other leg of the shackle out of the hole to open the lock; inserting the other leg of the shackle into the first hole again and clockwise turning the projection by turning the key until the key has turned about 360 degrees will counterclockwise pivot the engagement member to maintain its contact with the projection and cause the locking dog to pivotably enter into the slot with the open mark remained exposing; turning the tumbler wheels to a set series of numbers will unlock the locking bar and pressing the push button will move the locking bar inward with the pivot assembly pivoted clockwise, thereby causing the locking dog to clear the slot and counterclockwise pivoting the other leg of the shackle out of the hole to open the lock wherein the engagement member contacts the hook and pivots counterclockwise, the open mark is stopped by the key turning mechanism, the locked mark is exposed at the window, the tab disengages with the locked mark, and the sliding member slides toward the projection; and releasing the push button will cause the locked mark to contact the tab and inserting the other leg of the shackle into the hole will lock the lock with the locked mark exposed at the window.

The above and other objects, features and advantages of the present invention will become apparent from the following detailed description taken with the accompanying drawings.

DETAILED DESCRIPTION OF THE INVENTION

Figure 1:
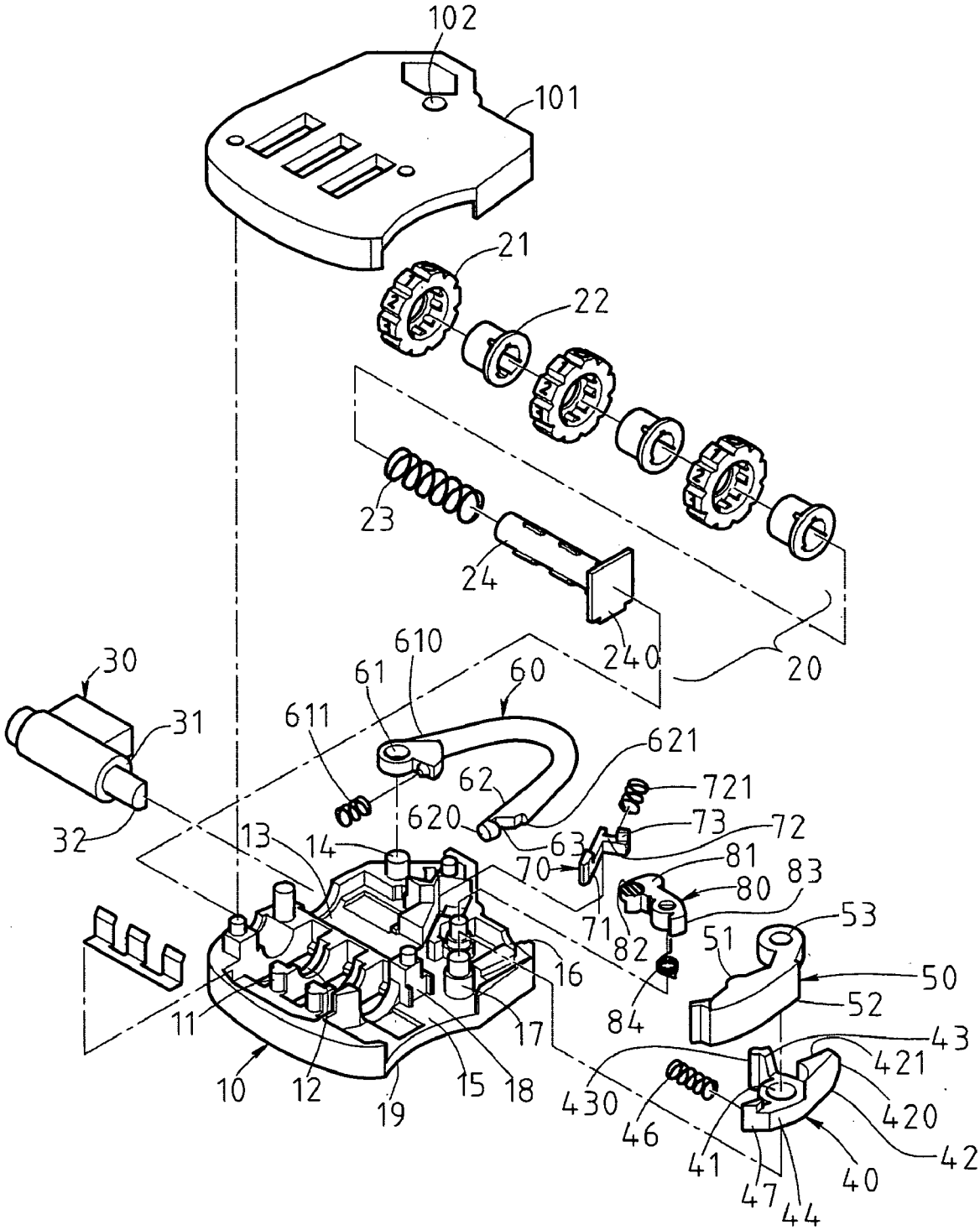
FIG. 1 is an exploded view of a preferred embodiment of combination lock and padlock combination according to the invention.
Figure 2:
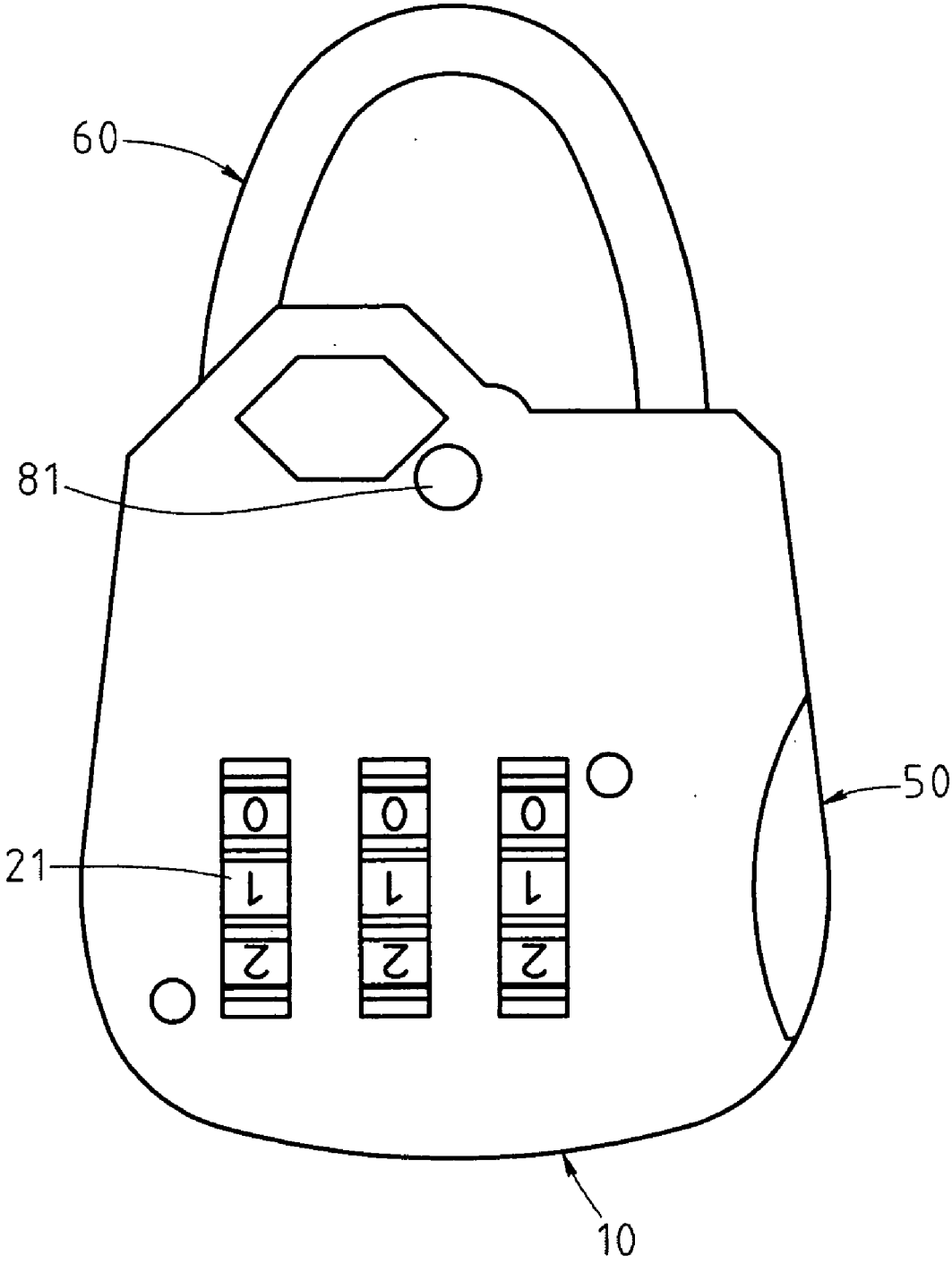
FIG. 2 is a perspective view of the assembled combination lock and padlock combination where the locked mark is exposed.

Referring to FIGS. 1 to 7, a combination lock and padlock combination (i.e., lock) constructed in accordance with the invention is shown and comprises a housing 10, a tumbler wheel assembly 20, a key turning assembly 30, a pivot assembly 40, a push button 50, a U-shaped shackle 60, a catch assembly 70, and an opening warning assembly 80. Each component will be described in detail below.

The housing 10 comprises a cover 101 having a window 102 proximate its top edge, and a base including three spaced seats 11 each having a half circular recess 12 on its top, a groove 13 adjacent one sides of the seats 11, a first pin 14 adjacent the groove 13, a side cavity 15 in communication with the external and both the groove 13 and the seats 11, a first hole 16 in communication with the external and the cavity 15, a second pin 17 in the cavity 15 proximate one end of the groove 13, a receptacle 18 at an inner portion of the cavity 15 adjacent the second pin 17, and an opening 19 at the mouth of the cavity 15.

The tumbler wheel assembly 20 is anchored in the recesses 12 and comprises three tumbler wheels 21, three inner, hollow cylinders 22 each fitted in the tumbler wheel 21, a bar 24 having a plurality of sets of projections disposed axially along its surface and a flat enlargement 240 at one end adjacent the opening 19, a first spring 23 put on a shank of the bar 24 being compressed between the enlargement 240 and the cylinder 22.

The key turning mechanism 30 is disposed in the groove 13 and comprises a keyhole (not shown) and a rotatable shaft 31 having a projection 32 of half circular section protruded from an inner end thereof toward the cavity 15.

The pivot assembly 40 is disposed in the cavity 15 and comprises a second hole 41 pivotably put on the second pin 17, a base 44 disposed on the opening 19, a latch 42 extended from one end of the base 44 toward the first hole 16 and having a locking dog 420 at an open end and a slope 421 on the locking dog 420, an engagement member 43 having a round end 430, a protrusion 47 at the other end of the base 44, a protuberance (not shown) extended in a direction perpendicular to that of the protrusion 47, and a second spring 46 compressed between the protrusion 47 and the receptacle 18.

The push button 50 comprises a nose 51 at an inner surface urged against the enlargement 240, an arm 52 disposed on the base 44, and a third hole 53 at one end put on an upper, annular flange on the second hole 41 for pivoting both the push button 50 and the pivot assembly 40 about the second pin 17.

The shackle 60 comprises an aperture 61 at one leg, the aperture 61 put on the first pin 14 so that the shackle 60 is adapted to pivot about the housing 10, an outer stop 610 adjacent the aperture 61, a third spring 611 compressed between the stop 610 and the key turning mechanism 30, a slot 63 at an end of the other leg 62, a notch 621 at a mouth of the slot 63, and an arcuate end 620 below the slot 63 for facilitating insertion of the other leg 62 into the first hole 16 or removal from same.

The L-shaped catch assembly 70 comprises a sliding member 71 at one end, a well 72 at a bending point, a fourth spring 721 anchored between the well 72 and an inner wall of the housing 10, and a tab 73 projected from the other end.

The opening warning assembly 80 comprises a locked mark 81 at one end, an open mark 82 adjacent the locked mark 81, a hook 83, and a torsion spring 84 put on a pole on an inner surface of the base of the housing 10, and the pole being inserted into a hole of the opening warning assembly 80 such that the opening warning assembly 80 is adapted to pivot about the pole (i.e., the housing 10).

Figure 3:
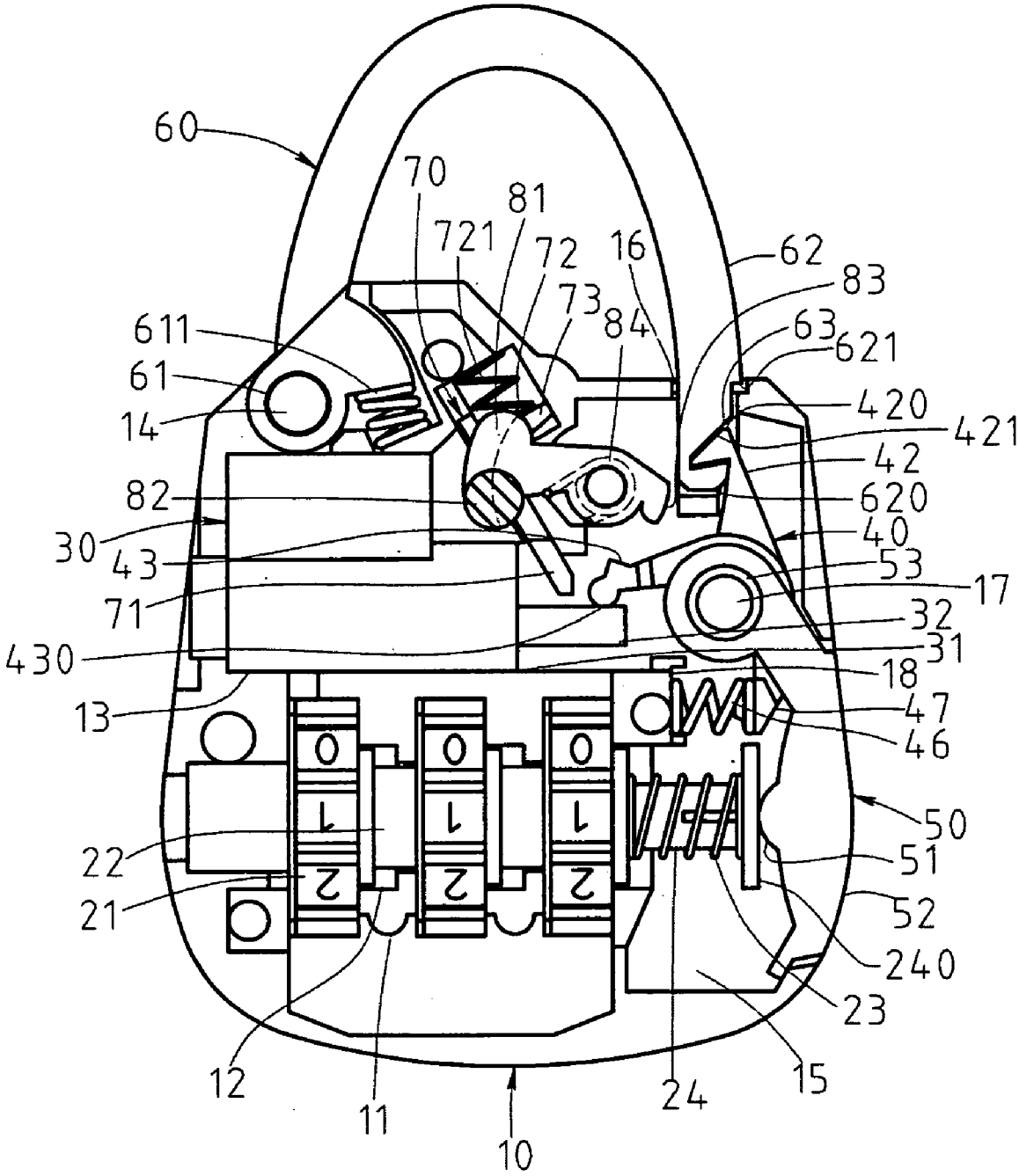
FIG. 3 is a top plan view of the combination lock and padlock combination with cover removed and the combination lock and padlock combination in its locked position.

Referring to FIG. 3 specifically, in a locked position of the lock the outward pushed enlargement 24 is stopped by the nose 51, the round end 430 contacts the projection 320, the locking dog 420 is anchored in the slot 63, and the locked mark 81 is aligned with the window 102 and is thus exposed.

Figure 4:
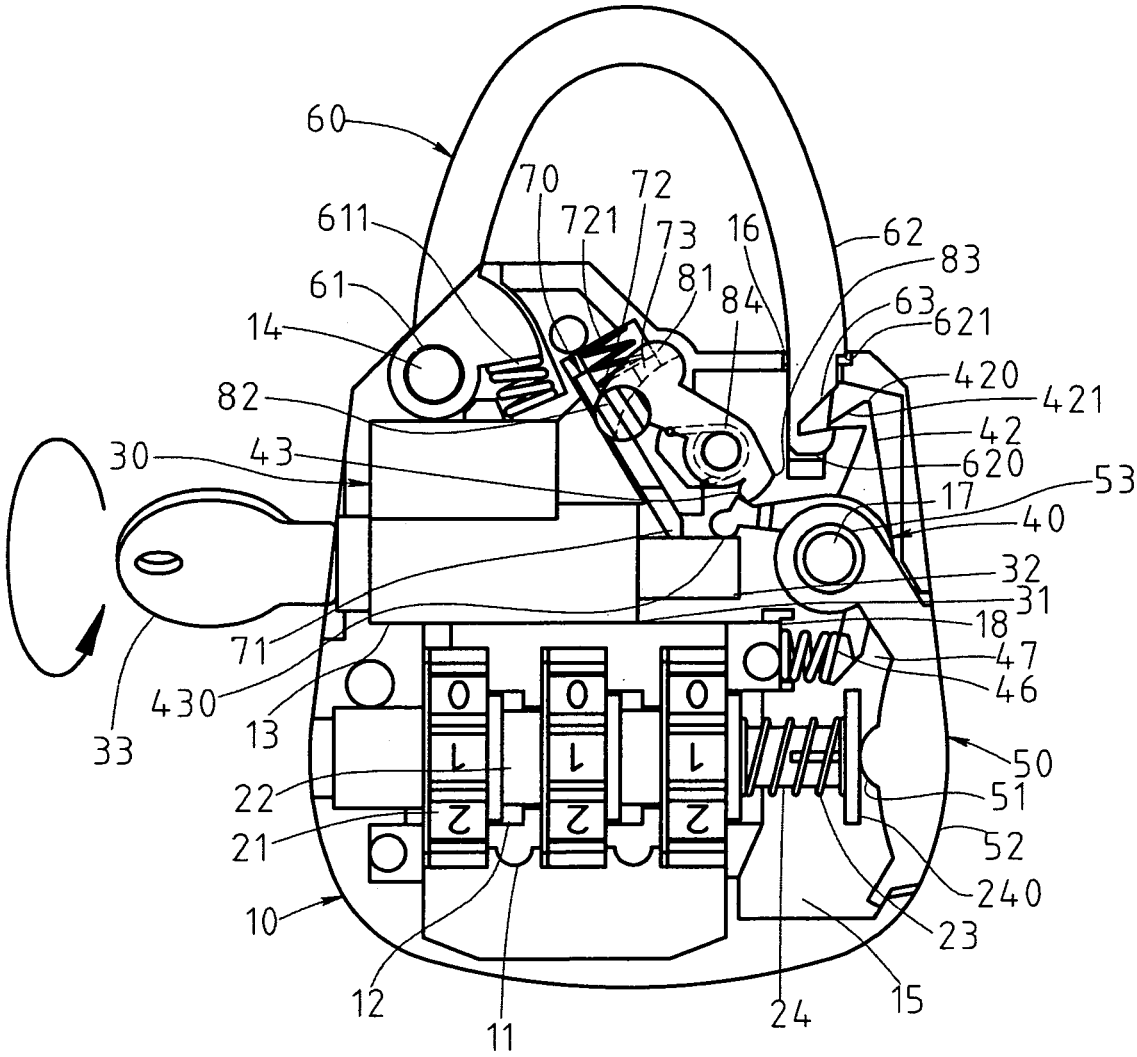
FIG. 4 is a view similar to FIG. 3, where a key is inserted into a keyhole for opening the combination lock and padlock combination.

Referring to FIG. 4 specifically, an operation of enabling a person to open the lock by a key will now be described in detail below. A person can insert a key 33 into the keyhole to clockwise turn the projection 32 about 90 degrees. And in turn, the projection 32 contacts and pushes the sliding member 71 to compress the fourth spring 721. At the same time, the tab 73 moves toward top of the housing 10. Also, the locked mark 81 pivots clockwise about the torsion spring 84 until the hook 83 is stopped by the engagement member 43. As a result, the locked mark 81 is not aligned with the window 102 (i.e., the locked mark 81 is concealed) and the open mark 82 is aligned with the window 102 (i.e., exposed).

Figure 5:
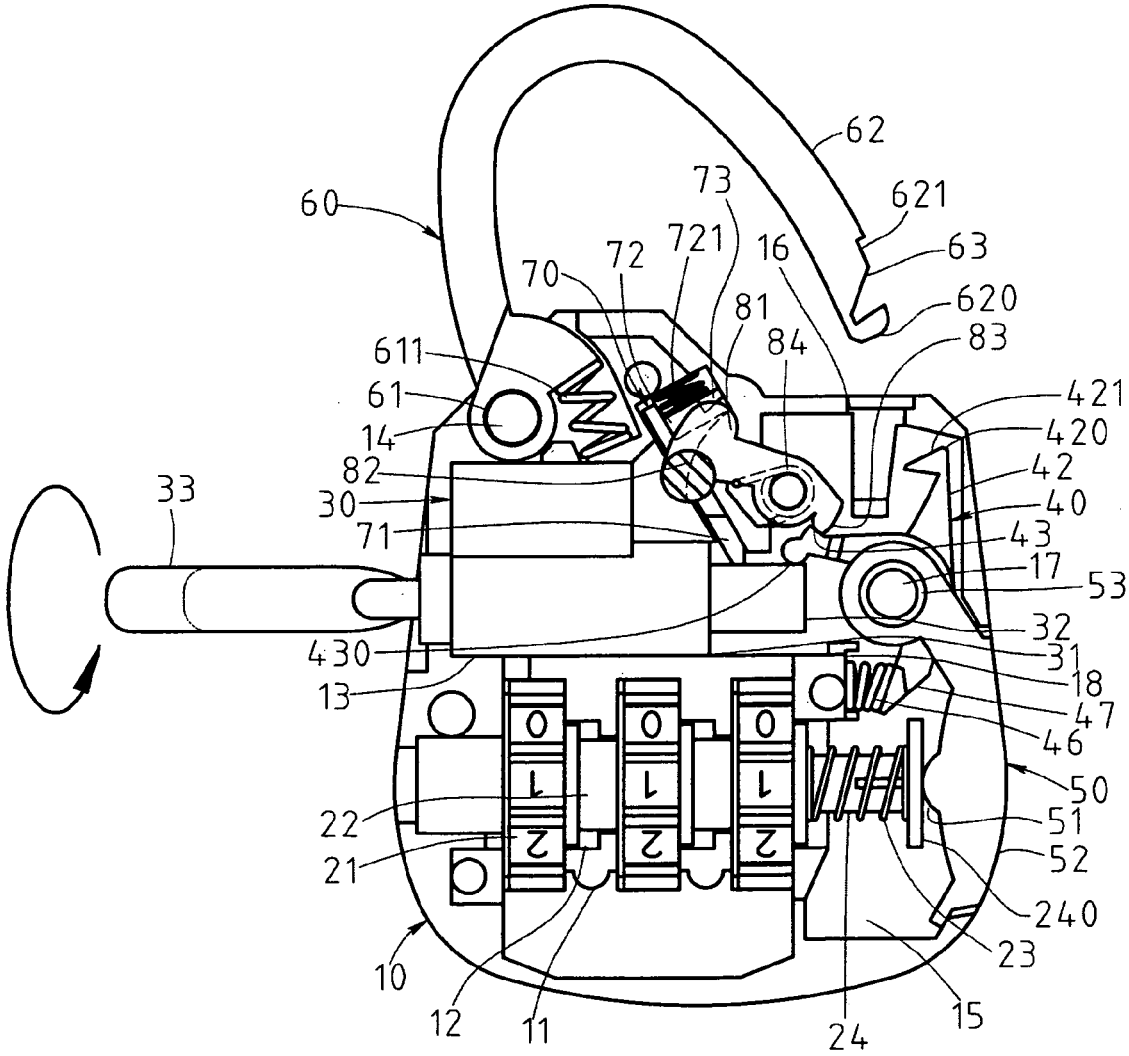
FIG. 5 is a view similar to FIG. 3, where the combination lock and padlock combination is open.

Referring to FIG. 5 specifically, as a continuation of the key opening operation the projection 32 turns by further turning the key 33. The round end 430 (i.e., the engagement member 43) pivots clockwise about the second pin 17. And in turn, the locking dog 420 clears the slot 63 with the second spring 46 being compressed. Once the locking dog 420 clears the slot 63, the other leg 62 of the shackle 60 pivots counterclockwise to clear the first hole 16 due to the expansion of the third spring 611. As a result, the lock is open.

Figure 6:
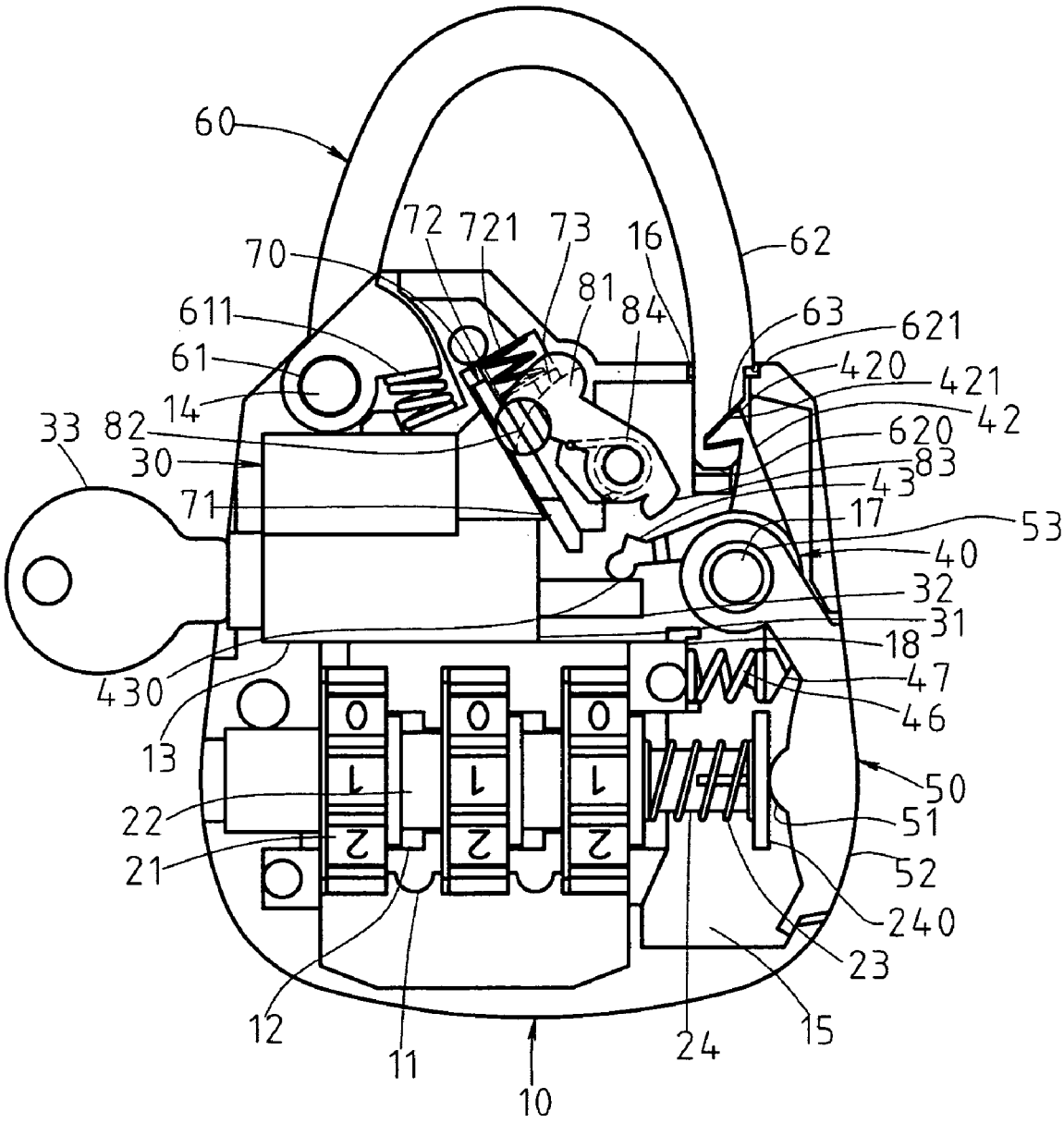
FIG. 6 is a view similar to FIG. 3, where the combination lock and padlock combination is locked again.
Figure 7:
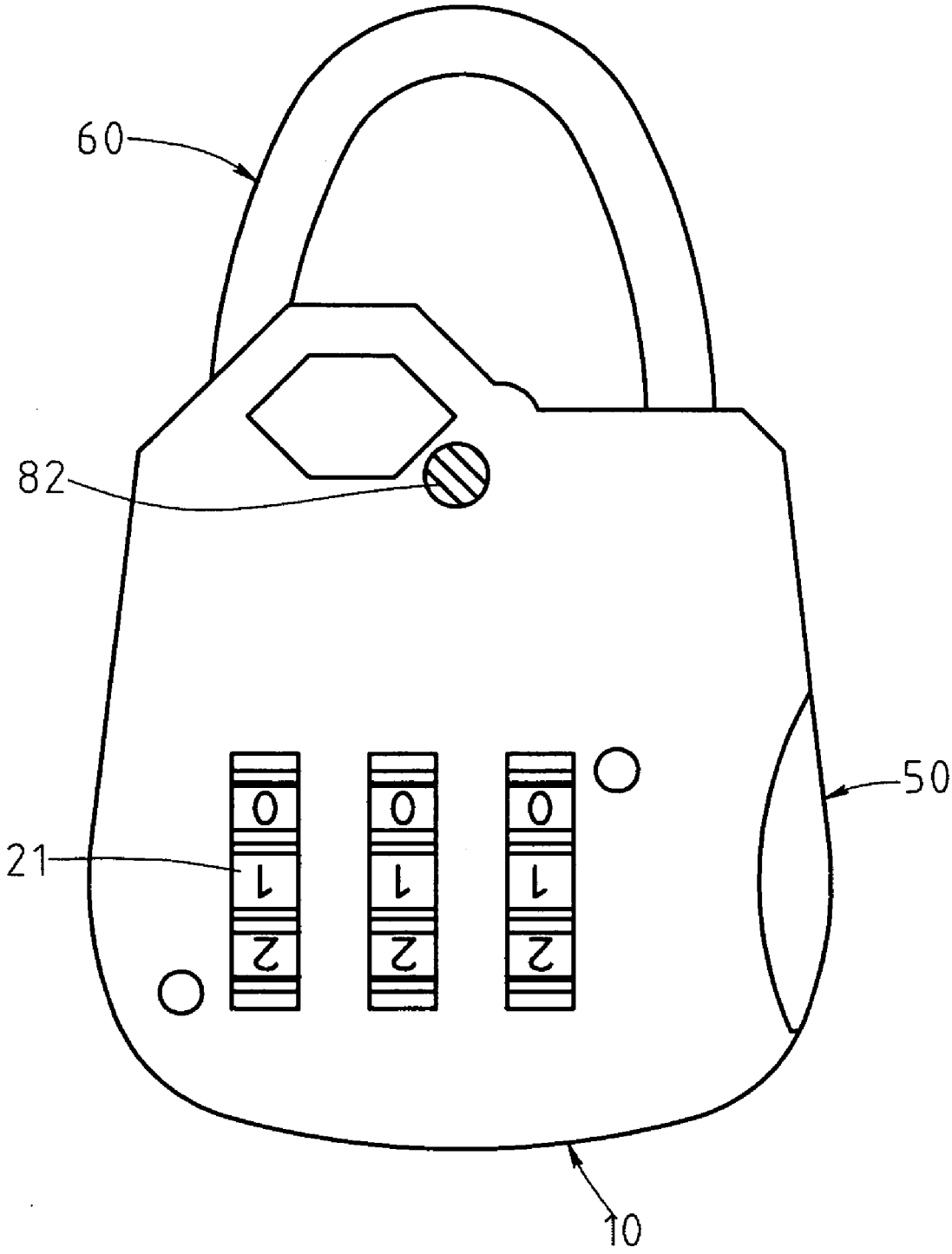
FIG. 7 is a view similar to FIG. 2, where the open mark is exposed.

Referring to FIG. 6 specifically, for locking the lock again the person may insert the other leg 62 of the shackle 60 into the first hole 16. Next, clockwise turn the key 33 for turning the projection 32 as a continuation of the key turning operation until the turning angle is 360 degrees calculated from the position of FIG. 3 to the position of FIG. 6 (i.e., turn a full circle). At the same time, the engagement member 43 pivots counterclockwise to maintain its contact with the projection 32 with the second spring 46 being expanded. As such, the locking dog 420 pivotably enters into the slot 63 again due to the expansion of the second spring 46. But the open mark 82 remains motionless because the torsion spring 84 continues to exert a force on the opening warning assembly 80. As a result, the open mark 82 is still aligned with the window 102 (i.e., exposed).

Figure 8:
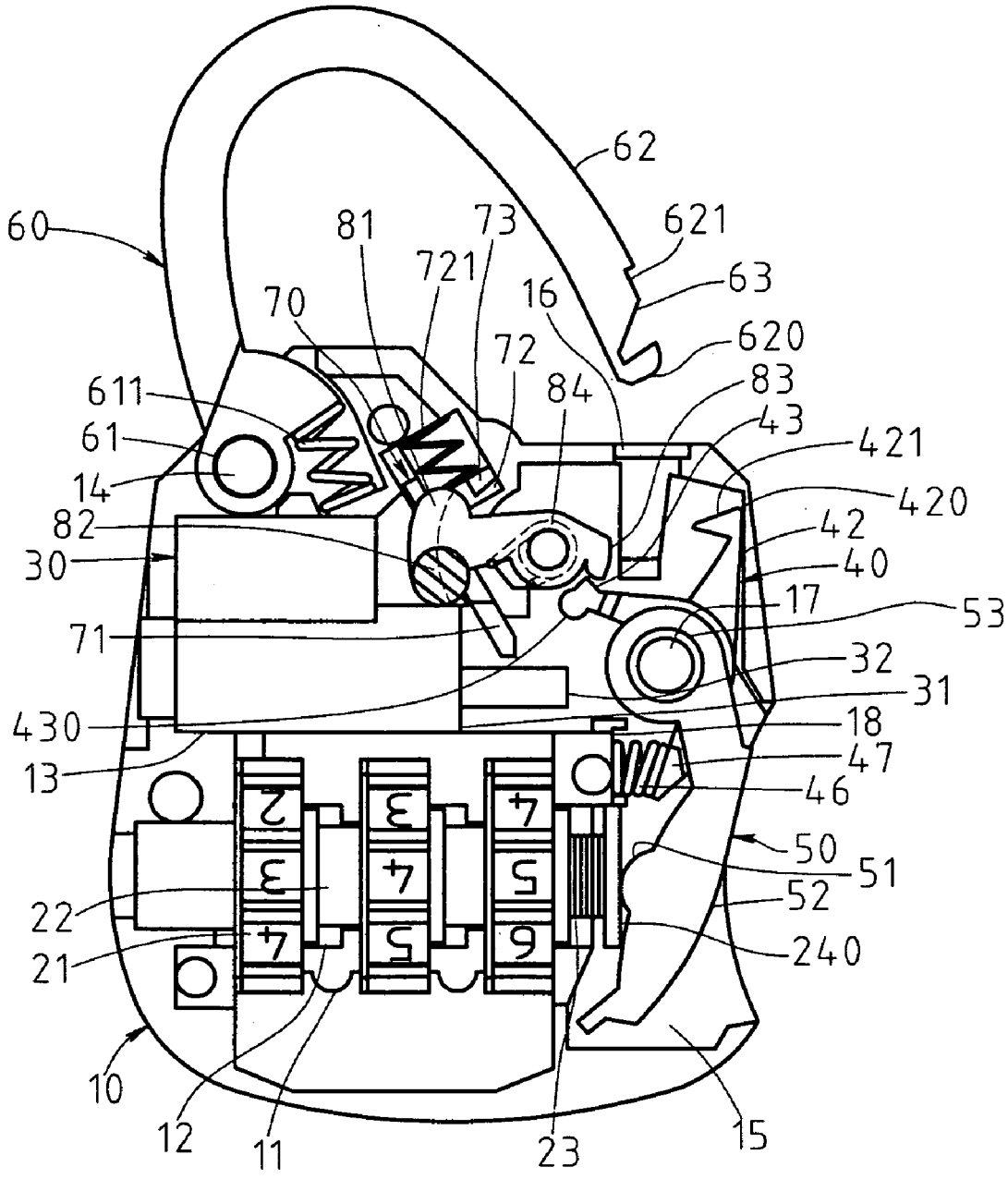
FIGS. 8 and 9 are views similar to FIG. 3 showing the combination lock and padlock combination has been opened by turning tumbler wheels to a set series of numbers.
Figure 9:
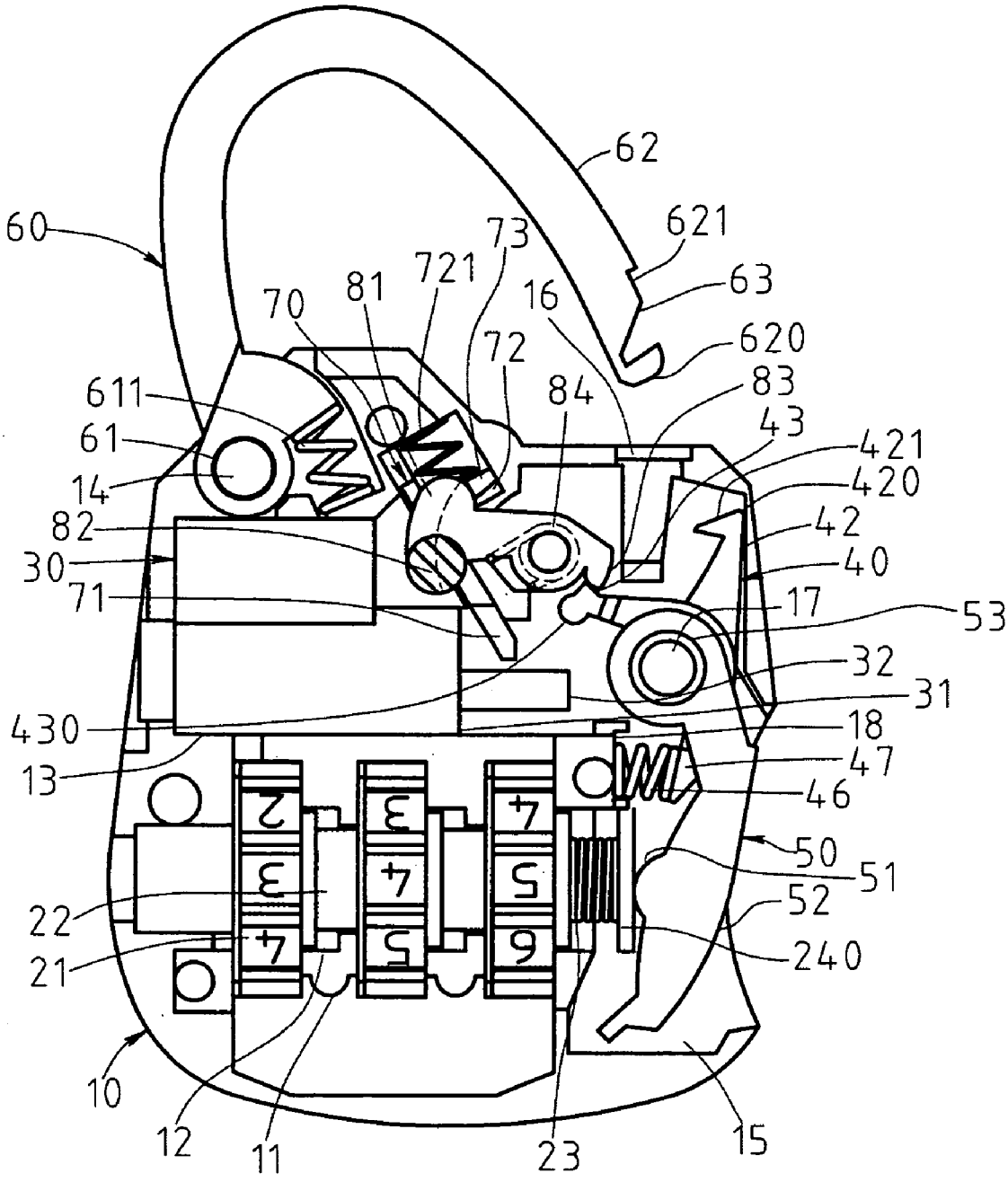

Referring to FIGS. 8 and 9 in conjunction with FIG. 6, an unlocking operation of the invention by turning the tumbler wheels 21 to a set series of numbers will now be described in detail below. A person can turn the tumbler wheels 21 with the cylinders 22 turned the same. This turning will continue until the correct set series of numbers (i.e., combination) are shown on openings of the housing 10. At this moment, the bar 24 is unlocked. Thus, the person may press the push button 50 to move the enlargement 240 (i.e., the bar 24) inward relative to the cylinders 22 with the first spring 23 being compressed. Also, the second spring 46 is compressed (i.e., both the protrusion 47 and the pivot assembly 40 pivot clockwise). As such, the locking dog 420 clears the slot 63. Once the locking dog 420 clears the slot 63, the other leg 62 of the shackle 60 pivots counterclockwise to clear the first hole 16 due to the expansion of the third spring 611. As a result, the lock is open.

The round end 430 contacts the hook 83 and pivots same counterclockwise when the lock is open. Also, the locked mark 81 pivots counterclockwise about the torsion spring 84 until the open mark 82 is stopped by the key turning mechanism 30. As a result, the locked mark 81 is aligned with the window 102 (i.e., the locked mark 81 is exposed). Also, the tab 73 disengages with the locked mark 81 and the sliding member 71 slides toward the projection 32 by the expansion of the fourth spring 721. Releasing the push button 50 will cause the locked mark 81 to contact the tab 73 (see FIG. 9). Next, the person may insert the other leg 62 of the shackle 60 into the first hole 16 again to lock the lock again. At this locked position, the locked mark 81 is exposed at the window 102 (see FIG. 2).

Each of a number of persons sharing the lock may use a key to open the lock. Once the lock is open, the open mark is exposed on the lock housing so that any of other persons may be aware of the same by visually observing the open mark.

While the invention herein disclosed has been described by means of specific embodiments, numerous modifications and variations could be made thereto by those skilled in the art without departing from the scope and spirit of the invention set forth in the claims.

What is claimed is:

1. A combination lock and padlock combination as a lock comprising:

a housing comprising a cover including a window proximate its top, and a base including a plurality of spaced seats, a groove adjacent the seats, a side cavity in communication with the external and both the groove and the seats, and a top hole in communication with the external and the cavity;

a tumbler wheel assembly seated on the seats and comprising a plurality of tumbler wheels, a plurality of hollow cylinders each fitted in the tumbler wheel, a spring-biased locking bar disposed axially in the cylinders and having an enlarged head;

a key turning mechanism disposed in the groove and comprising a keyhole and a rotatable shaft including a projection of half circular section protruded from an inner end thereof toward the cavity;

a spring-biased pivot assembly disposed in the cavity and being pivotal about the base, the pivot assembly comprising a latch extended from one end and including a locking dog at its open end, and an engagement member contacted the projection;

an arm-shaped push button disposed on the pivot assembly, both the push button and the pivot assembly being co-pivotal about the base, the push button comprising an inner nose urged against the head of the locking bar;

a U-shaped shackle comprising one spring-biased leg pivotably provided in the housing, and a slot at an end of the other leg with the locking dog fastened therein in a locked position of the lock;

a spring-biased L-shaped catch assembly comprising a sliding member at one end and a tab projected from the other end; and a spring-biased opening warning assembly pivotably provided in the housing and comprising a locked mark at one end exposed at the window in the locked position of the lock, an open mark adjacent the locked mark, and a hook at the other end; whereby:

inserting a key into the keyhole to clockwise turn the projection about 90 degrees will cause the projection to push the sliding member and move the tab toward a top of the housing, thereby clockwise pivoting the locked mark until the hook is stopped by the engagement member and the open mark is exposed at the window;

continuing to turn the projection will clockwise pivot the engagement member to cause the locking dog to clear the slot, thereby counterclockwise pivoting the other leg of the shackle out of the hole to open the lock;

inserting the other leg of the shackle into the first hole again and clockwise turning the projection by turning the key until the key has turned about 360 degrees will counterclockwise pivot the engagement member to maintain its contact with the projection and cause the locking dog to pivotably enter into the slot with the open mark remained exposing;

turning the tumbler wheels to a set series of numbers will unlock the locking bar and pressing the push button will move the locking bar inward with the pivot assembly pivoted clockwise, thereby causing the locking dog to clear the slot and counterclockwise pivoting the other leg of the shackle out of the hole to open the lock wherein the engagement member contacts the hook and pivots counterclockwise, the open mark is stopped by the key turning mechanism, the locked mark is exposed at the window, the tab disengages with the locked mark, and the sliding member slides toward the projection; and releasing the push button will cause the locked mark to contact the tab and inserting the other leg of the shackle into the hole will lock the lock with the locked mark exposed at the window.

* * * * *